US006080301A

United States Patent [19]

Berlowitz et al.

[11] Patent Number: 6,080,301

[45] Date of Patent: Jun. 27, 2000

[54] PREMIUM SYNTHETIC LUBRICANT BASE STOCK HAVING AT LEAST 95% NON-CYCLIC ISOPARAFFINS

[75] Inventors: Paul J. Berlowitz, E. Windsor; Jacob J. Habeeb, Westfield, both of N.J.; Robert J. Wittenbrink, Baton Rouge, La.

[73] Assignee: ExxonMobil Research and Engineering Company, Florham Park, N.J.

[21] Appl. No.: 09/148,280

[22] Filed: Sep. 4, 1998

[51] Int. Cl.[7] ..... C10G 71/00; C07C 7/20

[52] U.S. Cl. ..... 208/18; 208/19; 585/1

[58] Field of Search ..... 585/1; 208/18, 208/19

[56] References Cited

U.S. PATENT DOCUMENTS

| | | | |
|---|---|---|---|
| 3,268,439 | 8/1966 | Tupman et al. | 208/112 |
| 4,832,819 | 5/1989 | Hamner | 208/27 |
| 4,943,672 | 7/1990 | Hamner et al. | 585/737 |
| 5,404,015 | 4/1995 | Chimenti et al. | 250/339.12 |
| 5,419,185 | 5/1995 | Chimenti et al. | 73/54.01 |
| 5,424,542 | 6/1995 | Chimenti et al. | 250/339.12 |
| 5,426,053 | 6/1995 | Chimenti et al. | 436/55 |
| 5,475,612 | 12/1995 | Espinosa et al. | 364/500 |

FOREIGN PATENT DOCUMENTS

| | | |
|---|---|---|
| 0776959 | 6/1997 | European Pat. Off. . |
| 9721788 | 6/1997 | WIPO . |
| WO99/20720 | 4/1999 | WIPO . |

OTHER PUBLICATIONS

L.M. Petrova, et al, "The Composition and Properties of Lube Oils from Heavy Crudes Produced from Permian Deposits", Chemistry and Technology of Fuels and Oils, vol. 31, Nos. 5–6 (1995), pp. 236–240.

K.I. Zimina, et al, "Method of Comprehensive Investigation of the Composition, Structure and Properties of Oil Hydrocarbons", Scientific Papers of the Prague Institute of Chemical Technology, D 46 (1982), Technology of Fuel, pp. 89–103.

D. Christakudis, et al, "Several Properties of Lubricating Oils Produced by Thermal Diffusion", Organic–Technical Chemistry, Chemistry Dept. at the Bergakademie at Freiberg and presented to the 10th International Symposium "Lubricants, Lubrication and Bearing Engineering" (Aug. 27–31, 1998), pp. 32–41.

G.E. Cranton, "Composition and Oxidation of Petroleum Fractions", Elsevier Scientific Publishing Company, Thermochimica Acta (1976), 14(1–2), pp. 201–208.

G.E. Fodor, "An Analysis of Petroleum Fuels by Midband Infrared Spectroscopy", SAE International Congress (Detroit Feb. 28–Mar. 3, 1994), SAE Meeting Paper (1994, 14 pps.

S. Garrigues, et al, "Multivariate Calibrations in Fourier Transform Infrared Spectrometry for Prediction of Kerosene Properties", Analytical Chimica Acta 317 (1–3) (1995), pp. 95–105.

*Primary Examiner*—Marian C. Knode
*Assistant Examiner*—Thuan D. Dang
*Attorney, Agent, or Firm*—Jay Simon; Jonathan N. Provoost

[57] ABSTRACT

A premium synthetic lubricating oil base stock having a high VI and low pour point is made by hydroisomerizing a Fischer-Tropsch synthesized waxy, paraffinic feed wax and then dewaxing the hydroisomerate to form a 650–750° F.+ dewaxate. The waxy feed has an initial boiling point in the range of about 650–750° F., from which it continuously boils up to at least 1050° F. and has a $T_{90}$–$T_{10}$ temperature difference of at least 350° F. The feed is preferably hydroisomerized without any pretreatment, other than optional fractionation. The 650–750° F.+ dewaxate is fractionated into two or more base stocks of different viscosity.

8 Claims, No Drawings

PREMIUM SYNTHETIC LUBRICANT BASE STOCK HAVING AT LEAST 95% NON-CYCLIC ISOPARAFFINS

BACKGROUND OF THE DISCLOSURE

1. Field of the Invention

The invention relates to premium synthetic lubricant base stocks derived from waxy Fischer-Tropsch hydrocarbons, their preparation and use. More particularly the invention relates to a high VI and low pour point synthetic lubricating oil base stock made by reacting $H_2$ and CO in the presence of a Fischer-Tropsch catalyst to form waxy hydrocarbons boiling in the lubricating oil range, hydroisomerizing the waxy hydrocarbons having an initial boiling point in the range of 650–750° F., dewaxing the hydroisomerate, removing light ends from the dewaxate and fractionating to recover a plurality of base stocks from the dewaxate.

2. Background of the Invention

Current trends in the design of automotive engines require higher quality crankcase and transmission lubricating oils with high VI's and low pour points. Processes for preparing lubricating oils of low pour point from petroleum derived feeds typically include atmospheric and/or vacuum distillation of a crude oil (and often deasphalting the heavy fraction), solvent extraction of the lube fraction to remove aromatic unsaturates and form a raffinate, hydrotreating the raffinate to remove heteroatom compounds and aromatics, followed by either solvent or catalytically dewaxing the hydrotreated raffinate to reduce the pour point of the oil. Some synthetic lubricating oils are based on a polymerization product of polyalphaolefins (PAO). These lubricating oils are expensive and can shrink seals. In the search for synthetic lubricating oils, attention has recently been focused on Fischer-Tropsch wax that has been synthesized by reacting $H_2$ with CO.

Fischer-Tropsch wax is a term used to describe waxy hydrocarbons produced by a Fischer-Tropsch hydrocarbon synthesis processes in which a synthesis gas feed comprising a mixture of $H_2$ and CO is contacted with a Fischer-Tropsch catalyst, so that the $H_2$ and CO react under conditions effective to form hydrocarbons. U.S. Pat. No. 4,943,672 discloses a process for converting waxy Fischer-Tropsch hydrocarbons to a lube oil base stock having a high (viscosity index) VI and a low pour point, wherein the process comprises sequentially hydrotreating, hydroisomerizing, and solvent dewaxing. A preferred embodiment comprises sequentially (i) severely hydrotreating the wax to remove impurities and partially convert it, (ii) hydroisomerizing the hydrotreated wax with a noble metal on a fluorided alumina catalyst, (iii) hydrorefining the hydroisomerate, (iv) fractionating the hydroisomerate to recover a lube oil fraction, and (v) solvent dewaxing the lube oil fraction to produce the base stock. European patent publication EP 0 668 342 A1 suggests a processes for producing lubricating base oils by hydrogenating or hydrotreating and then hydroisomerizing a Fischer-Tropsch wax or waxy raffinate, followed by dewaxing, while EP 0 776 959 A2 recites hydroconverting Fischer-Tropsch hydrocarbons having a narrow boiling range, fractionating the hydroconversion effluent into heavy and light fractions and then dewaxing the heavy fraction to form a lubricating base oil having a VI of at least 150.

SUMMARY OF THE INVENTION

Lubricant base stocks are produced by (i) hydroisomerizing waxy, Fischer-Tropsch synthesized hydrocarbons having an initial boiling point in the range of 650–750° F. and an end point of at least 1050° F. (hereinafter "waxy feed") to form a hydroisomerate having an initial boiling point in said 650–750° F. range, (ii) dewaxing the 650–750° F.+ hydroisomerate to reduce its pour point and form a 650–750° F+ dewaxate, and (iii) fractionating the 650–750° F.+ dewaxate to form two or more fractions of different viscosity as the base stocks. These base stocks are premium synthetic lubricating oil base stocks of high purity having a high VI, a low pour point and are isoparaffinic, in that they comprise at least 95 wt. % of non-cyclic isoparaffins having a molecular structure in which less than 25% of the total number of carbon atoms are present in the branches, and less than half the branches have two or more carbon atoms. The base stock of the invention and those comprising PAO oil differ from oil derived from petroleum oil or slack wax in an essentially nil heteroatom compound content and in comprising essentially non-cyclic isoparaffins. However, whereas a PAO base stock comprises essentially star-shaped molecules with long branches, the isoparaffins making up the base stock of the invention have mostly methyl branches. This is explained in detail below. Both the base stocks of the invention and fully formulated lubricating oils using them have exhibited properties superior to PAO and conventional mineral oil derived base stocks, and corresponding formulated lubricating oils. The present invention relates to these base stocks and to a process for making them. Further, while in many cases it will be advantageous to employ only the base stock of the invention for a particular lubricant, in other cases the base stock of the invention may be mixed or blended with one or more base stocks selected from the group consisting of (a) a hydrocarbonaceous base stock, (b) a synthetic base stock, and mixture thereof Typical examples include base stocks derived from (i) PAO, (ii) mineral oil, (iii) a mineral oil slack wax hydroisomerate, and mixture thereof. Because the base stocks of the invention and lubricating oils based on these base stocks are different, and most often superior to, lubricants formed from other base stocks, it will be obvious to the practitioner that a blend of another base stock with at least 20, preferably at least 40 and more preferably at least 60 wt. % of the base stock of the invention, will still provide superior properties in many most cases, although to a lesser degree than only if the base stock of the invention is used.

The waxy feed used in the process of the invention comprises waxy, highly paraffinic and pure Fischer-Tropsch synthesized hydrocarbons (sometimes referred to as Fischer-Tropsch wax) having an initial boiling point in the range of from 650–750° F. and continuously boiling up to an end point of at least 1050° F., and preferably above 1050° F. (1050° F.+), with a $T_{90}$–$T_{10}$ temperature spread of at least 350° F. The temperature spread refers to the temperature difference in ° F. between the 90 wt. % and 10 wt. % boiling points of the waxy feed, and by waxy is meant including material which solidifies at standard conditions of room temperature and pressure. The hydroisomerization is achieved by reacting the waxy feed with hydrogen in the presence of a suitable hydroisomerization catalyst and preferably a dual function catalyst which comprises at least one catalytic metal component to give the catalyst a hydrogenation/dehydrogenation function and an acidic metal oxide component to give the catalyst an acid hydroisomerization function. Preferably the hydroisomerization catalyst comprises a catalytic metal component comprising a Group VIB metal component, a Group VIII non-noble metal component and an amorphous alumina-silica component. The hydroisomerate is dewaxed to reduce the pour point of the oil, with the dewaxing achieved either catalytically or with the use of solvents, both of which are well known dewaxing processes, with the catalytic dewaxing achieved using any of the well known shape selective catalysts useful for catalytic dewaxing. Both hydroisomerization and catalytic dewaxing convert a portion of the 650–750° F.+ material to lower boiling (650–750° F.–) hydrocarbons. In the practice of the invention, it is preferred that a slurry Fischer-Tropsch hydrocarbon synthesis process be used for synthesizing the waxy feed and particularly one employing a Fischer-Tropsch catalyst comprising a catalytic cobalt component to provide a high alpha for producing the more desirable higher molecular weight paraffins. These processes are also well known to those skilled in the art.

The waxy feed preferably comprises the entire 650–750° F.+ fraction formed by the hydrocarbon synthesis process, with the exact cut point between 650° F. and 750° F. being determined by the practitioner and the exact end point preferably above 1050° F. determined by the catalyst and process variables used for the synthesis. The waxy feed also comprises more than 90%, typically more than 95% and preferably more than 98 wt. % paraffinic hydrocarbons, most of which are normal paraffins. It has negligible amounts of sulfur and nitrogen compounds (e.g., less than 1 wppm), with less than 2,000 wppm, preferably less than 1,000 wppm and more preferably less than 500 wppm of oxygen, in the form of oxygenates. Waxy feeds having these properties and useful in the process of the invention have been made using a slurry Fischer-Tropsch process with a catalyst having a catalytic cobalt component.

In contrast to the process disclosed in U.S. Pat. No. 4,943,672 referred to above, the waxy feed need not be hydrotreated prior to the hydroisomerization and this is a preferred embodiment in the practice of the invention. Eliminating the need for hydrotreating the Fischer-Tropsch wax is accomplished by using the relatively pure waxy feed, and preferably in combination with a hydroisomerization catalyst resistant to poisoning and deactivation by oxygenates that may be present in the feed. This is discussed in detail below. After the waxy feed has been hydroisomerized, the hydroisomerate is typically sent to a fractionater to remove the 650–750° F– boiling fraction and the remaining 650–750° F.+ hydroisomerate dewaxed to reduce its pour point and form a dewaxate comprising the desired lube oil base stock. If desired however, the entire hydroisomerate may be dewaxed. If catalytic dewaxing is used, that portion of the 650–750° F.+ material converted to lower boiling products is removed or separated from the 650–750° F.+ lube oil base stock by fractionation, and the 650–750° F.+ dewaxate fractionated separated into two or more fractions of different viscosity, which are the base stocks of the invention. Similarly, if the 650–750° F.– material is not removed from the hydroisomerate prior to dewaxing, it is separated and recovered during fractionation of the dewaxate into the base stocks.

DETAILED DESCRIPTION

The composition of the base stock of the invention is different from one derived from a conventional petroleum oil or slack wax, or a PAO. The base stock of the invention comprises essentially (≧99+ wt. %) all saturated, paraffinic and non-cyclic hydrocarbons. Sulfur, nitrogen and metals are present in amounts of less than 1 wppm and are not detectable by x-ray or Antek Nitrogen tests. While very small amounts of saturated and unsaturated ring structures may be present, they are not identifiable in the base stock by presently known analytical methods, because the concentrations are so small. While the base stock of the invention is a mixture of various molecular weight hydrocarbons, the residual normal paraffin content remaining after hydroisomerization and dewaxing will preferably be less than 5 wt. % and more preferably less than 1 wt. %, with at least 50% of the oil molecules containing at least one branch, at least half of which are methyl branches. At least half, and more preferably at least 75% of the remaining branches are ethyl, with less than 25% and preferably less than 15% of the total number of branches having three or more carbon atoms. The total number of branch carbon atoms is typically less than 25%, preferably less than 20% and more preferably no more than 15% (e.g., 10–15%) of the total number of carbon atoms comprising the hydrocarbon molecules. PAO oils are a reaction product of alphaolefins, typically 1-decene and also comprise a mixture of molecules. However, in contrast to the molecules of the base stock of the invention which have a more linear structure comprising a relatively long back bone with short branches, the classic textbook description of a PAO is a star-shaped molecule, and in particular, tridecane which is illustrated as three decane molecules attached at a central point. PAO molecules have fewer and longer branches than the hydrocarbon molecules that make up the base stock of the invention. Thus, the molecular make up of a base stock of the invention comprises at least 95 wt. % isoparaffins having a relatively linear molecular structure, with less than half the branches having two or more carbon atoms and less than 25% of the total number of carbon atoms present in the branches.

As those skilled in the art know, a lubricating oil base stock is an oil possessing lubricating qualities boiling in the general lubricating oil range and is useful for preparing various lubricants such as lubricating oils and greases. Fully formulated lubricating oils (hereinafter "lube oil") are prepared by adding to the base stock an effective amount of at least one additive or, more typically, an additive package containing more than one additive, wherein the additive is at least one of a detergent, a dispersant, an antioxidant, an antiwear additive, a pour point depressant, a VI improver, a friction modifier, a demulsifier, an antifoamant, a corrosion inhibitor, and a seal swell control additive. Of these, those additives common to most formulated lubricating oils include a detergent or dispersant, an antioxidant, an antiwear additive and a VI improver, with others being optional depending on the intended use of the oil. An effective amount of one or more additives or an additive package containing one or more such additives is added to or blended into the base stock to meet one or more specifications, such as those relating to a lube oil for an internal combustion engine crankcase, an automatic transmission, a turbine or jet, hydraulic oil, etc., as is known. Various manufacturers sell such additive packages for adding to a base stock or to a blend of base stocks to form fully formulated lube oils for meeting performance specifications required for different applications or intended uses, and the exact identity of the various additives present in an additive pack is typically maintained as a trade secret by the manufacturer. Thus, additive packages can and often do contain many different chemical types of additives and the performance of the base stock of the invention with a particular additive or additive package can not be predicted a priori. That its performance differs from that of conventional and PAO oils with the same level of the same additives is itself proof of the chemistry of the base stock of the invention being different from that of the prior art base stocks. As set forth above, in many cases it will be advantageous to employ only a base stock derived from waxy Fischer-Tropsch hydrocarbons for a particular lubricant, while in other cases one or more additional base stocks may be mixed with, added to or blended with one or more of the Fischer-Tropsch derived base stocks. Such additional base stocks may be selected from the group consisting of (i) a hydrocarbonaceous base stock, (ii) a synthetic base stock and mixture thereof By hydrocarbonaceous is meant a primarily hydrocarbon type base stock derived from a conventional mineral oil, shale oil, tar, coal liquefaction, mineral oil derived slack wax, while a synthetic base stock will include a PAO, polyester types and other synthetics. Fully formulated lube oils made from the base stock of the invention have been found to perform at least as well as, and often superior to, formulated oils based on either a PAO or a conventional petroleum oil derived base stock. Depending on the application, using the base stock of the invention can mean that lower levels of additives are required for an improved performance specification, or an improved lube oil is produced at the same additive levels.

During hydroisomerization of the waxy feed, conversion of the 650–750° F.+ fraction to material boiling below this range (lower boiling material, 650–750° F.–) will range from about 20–80 wt. %, preferably 30–70% and more preferably from about 30–60%, based on a once through pass of the feed through the reaction zone. The waxy feed will typically contain 650–750° F.– material prior to the hydroisomerization and at least a portion of this lower boiling material will also be converted into lower boiling components. Any olefins and oxygenates present in the feed are hydrogenated during the hydroisomerization. The temperature and pressure in the hydroisomerization reactor will typically range from 300–900° F. (149–482° C.) and 300–2500 psig, with preferred ranges of 550–750° F. (288–400° C.) and 300–1200 psig, respectively. Hydrogen treat rates may range from 500 to 5000 SCF/B, with a preferred range of 2000–4000 SCF/B. The hydroisomerization catalyst comprises one or more Group VIII catalytic metal components, and preferably non-noble catalytic metal component(s), and an acidic metal oxide component to give the catalyst both a hydrogenation/dehydrogenation function and an acid hydrocracking function for hydroisomerizing the hydrocarbons. The catalyst may also have one or more Group VIB metal oxide promoters and one or more Group IB metals as a hydrocracking suppressant. In a preferred embodiment the catalytically active metal comprises cobalt and molybdenum. In a more preferred embodiment the catalyst will also contain a copper component to reduce hydrogenolysis. The acidic oxide component or carrier may include, alumina, silica-alumina, silica-alumina-phosphates, titania, zirconia, vanadia, and other Group II, IV, V or VI oxides, as well as various molecular sieves, such as X, Y and Beta sieves. The elemental Groups referred to herein are those found in the Sargent-Welch Periodic Table of the Elements, © 1968. It is preferred that the acidic metal oxide component include silica-alumina and particularly amorphous silica-alumina in which the silica concentration in the bulk support (as opposed to surface silica) is less than about 50 wt. % and preferably less than 35 wt. %. A particularly preferred acidic oxide component comprises amorphous silica-alumina in which the silica content ranges from 10–30 wt. %. Additional components such as silica, clays and other materials as binders may also be used. The surface area of the catalyst is in the range of from about 180–400 $m^2/g$, preferably 230–350 $m^2/g$, with a respective pore volume, bulk density and side crushing strength in the ranges of 0.3 to 1.0 mL/g and preferably 0.35–0.75 mL/g; 0.5–1.0 g/mL, and 0.8–3.5 kg/mm. A particularly preferred hydroisomerization catalyst comprises cobalt, molybdenum and, optionally, copper, together with an amorphous silica-alumina component containing about 20–30 wt. % silica. The preparation of such catalysts is well known and documented. Illustrative, but non-limiting examples of the preparation and use of catalysts of this type may be found, for example, in U.S. Pat. Nos. 5,370,788 and 5,378,348. As was stated above, the hydroisomerization catalyst is most preferably one that is resistant to deactivation and to changes in its selectivity to isoparaffin formation. It has been found that the selectivity of many otherwise useful hydroisomerization catalysts will be changed and that the catalysts will also deactivate too quickly in the presence of sulfur and nitrogen compounds, and also oxygenates, even at the levels of these materials in the waxy feed. One such example comprises platinum or other noble metal on halogenated aluimina, such as fluorided alumina, from which the fluorine is stripped by the presence of oxygenates in the waxy feed. A hydroisomerization catalyst that is particularly preferred in the practice of the invention comprises a composite of both cobalt and molybdenum catalytic components and an amorphous alumina-silica component, and most preferably one in which the cobalt component is deposited on the amorphous silica-alumina and calcined before the molybdenum component is added. This catalyst will contain from 10–20 wt. % $MoO_3$ and 2–5 wt. % CoO on an amorphous alumina-silica support component in which the silica content ranges from 10–30 wt. % and preferably 20–30 wt. % of this support component. This catalyst has been found to have good selectivity retention and resistance to deactivation by oxygenates, sulfur and nitrogen compounds found in the Fischer-Tropsch produced waxy feeds. The preparation of this catalyst is disclosed in U.S. Pat. Nos. 5,756,420 and 5,750,819, the disclosures of which are incorporated herein by reference. It is still further preferred that this catalyst also contain a Group IB metal component for reducing hydrogenolysis. The entire hydroisomerate formed by hydroisomerizing the waxy feed may be dewaxed, or the lower boiling, 650–750° F.– components may be removed by rough flashing or by fractionation prior to the dewaxing, so that only the 650–750° F.+ components are dewaxed. The choice is determined by the practitioner. The lower boiling components may be used for fuels.

The dewaxing step may be accomplished using either well known solvent or catalytic dewaxing processes and either the entire hydroisomerate or the 650–750° F.+ fraction may be dewaxed, depending on the intended use of the 650–750° F.– material present, if it has not been separated from the higher boiling material prior to the dewaxing. In solvent dewaxing, the hydroisomerate may be contacted with chilled ketone and other solvents such as acetone, MEK, MIBK and the like and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane, are also used for dewaxing, in which the hydroisomerate is mixed with liquid propane, a least a portion of which is flashed off to chill down the hydroisomerate to precipitate out the wax. The wax is separated from the raffinate by filtration, membranes or centrifugation. The solvent is then stripped out of the raffinate, which is then fractionated to produce the base stocks of the invention. Catalytic dewaxing is also well known in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling, 650–750° F.– materials, which are separated from the heavier 650–750° F.+ base stock fraction and the base stock fraction fractionated into two or more base stocks. Separation of the lower boiling material may be accomplished either prior to or during fraction of the 650–750° F.+ material into the desired base stocks.

The practice of the invention is not limited to the use of any particular dewaxing catalyst, but may be practiced with any dewaxing catalyst which will reduce the pour point of the hydroisomerate and preferably those which provide a reasonably large yield of lube oil base stock from the hydroisomerate. These include shape selective molecular sieves which, when combined with at least one catalytic metal component, have been demonstrated as useful for dewaxing petroleum oil fractions and slack wax and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective in the process of the invention comprises a noble metal, preferably Pt, composited with H-mordenite. The dewaxing may be accomplished with the catalyst in a fixed, fluid or slurry bed. Typical dewaxing conditions include a temperature in the range of from about 400–600° F., a pressure of 500–900 psig, $H_2$ treat rate of 1500–3500 SCFIB for flow-through reactors and LHSV of 0.1–10, preferably 0.2–2.0. The dewaxing is typically conducted to convert no more than 40 wt. % and preferably no more than 30 wt. % of the hydroisomerate having an initial boiling point in the range of 650–750° F. to material boiling below its initial boiling point.

In a Fischer-Tropsch hydrocarbon synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, Fischer-Tropsch hydrocarbon synthesis processes include processes in which the catalyst is in the form of a fixed bed, a fluidized bed and as a slurry of catalyst particles in a hydrocarbon slurry liquid. The stoichiometric mole ratio for a Fischer-Tropsch hydrocarbon synthesis reaction is 2.0, but there are many reasons for using other than a stoichiometric ratio as those skilled in the art know and a discussion of which is beyond the scope of the present invention. In a slurry hydrocarbon synthesis process the mole ratio of the $H_2$ to CO is typically about 2.1/1. The synthesis gas comprising a mixture of $H_2$ and CO is bubbled up into the bottom of the slurry and reacts in the presence of the particulate Fischer-Tropsch hydrocarbon synthesis catalyst in the slurry liquid at conditions effective to form hydrocarbons, at portion of which are liquid at the reaction conditions and which comprise the hydrocarbon slurry liquid. The synthesized hydrocarbon liquid is typically separated from the catalyst particles as filtrate by means such as simple filtration, although other separation means such as centrifugation can be used. Some of the synthesized hydrocarbons are vapor and pass out the top of the hydrocarbon synthesis reactor, along with unreacted synthesis gas and gaseous reaction products. Some of these overhead hydrocarbon vapors are typically condensed to liquid and combined with the hydrocarbon liquid filtrate. Thus, the initial boiling point of the filtrate will vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$–$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320–600° F., 80–600 psi and 100–40,000 V/hr/V, expressed as standard volumes of the gaseous CO and $H_2$ mixture (0° C., 1 atm) per hour per volume of catalyst, respectively. In the practice of the invention, it is preferred that the hydrocarbon synthesis reaction be conducted under conditions in which little or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable Fischer-Tropsch reaction types of catalyst comprise, for example, one or more Group VIII catalytic metals such as Fe, Ni, Co, Ru and Re, it is preferred in the process of the invention that the catalyst comprise a cobalt catalytic component In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above under the SUMMARY, the waxy feed used in the process of the invention comprises waxy, highly paraffinic and pure Fischer-Tropsch synthesized hydrocarbons (sometimes referred to as Fischer-Tropsch wax) having an initial boiling point in the range of from 650–750° F. and continuously boiling up to an end point of at least 1050° F., and preferably above 1050° F. (1050° F.+), with a $T_{90}$–$T_{10}$ temperature spread of at least 350° F. The temperature spread refers to the temperature difference in OF between the 90 wt. % and 10 wt. % boiling points of the waxy feed, and by waxy is meant including material which solidifies at standard conditions of room temperature and pressure. The temperature spread, while being at least 350° F., is preferably at least 400° F. and more preferably at least 450° F. and may range between 350° F. to 700° F. or more. Waxy feed obtained from a slurry Fischer-Tropsch process employing a catalyst comprising a composite of a catalytic cobalt component and a titania component have been made having $T_{10}$ and $T_{90}$ temperature spreads of as much as 490° F. and even 600° F., having more than 10 wt. % of 1050° F.+ material and even more than 15 wt. % of 1050° F.+ material, with respective initial and end boiling points of 500° F.–1245° F. and 350° F.–1220° F. Both of these samples continuously boiled over their entire boiling range. The lower boiling point of 350° F. was obtained by adding some of the condensed hydrocarbon overhead vapors from the reactor to the hydrocarbon liquid filtrate removed from the reactor. Both of these waxy feeds were suitable for use in the process of the invention, in that they contained material having an initial boiling point of from 650–750° F. which continuously boiled to an end point of above 1050° F., and a $T_{90}$–$T_{10}$ temperature spread of more than 350° F. Thus, both feeds comprised hydrocarbons having an initial boiling point of 650–750° F. and continuously boiled to an end point of more than 1050° F. These waxy feeds are very pure and contain negligible amounts of sulfur and nitrogen compounds. The sulfur and nitrogen contents are less than 1 wppm, with less than 500 wppm of oxygenates measured as oxygen, less than 3 wt. % olefins and less than 0.1 wt. % aromatics. The low oxygenate content of preferably less than 1,000 and more preferably less than 500 wppm results in less hydroisomerization catalyst deactivation.

The invention will be further understood with reference to the examples below. In all of these examples, the $T_{90}$–$T_{10}$ temperature spread was greater than 350° F.

EXAMPLES

Example 1

A synthesis gas comprising a mixture of $H_2$ and CO in a mole ratio ranging between 2.11–2.16 was fed into a slurry Fischer-Tropsch reactor in which the $H_2$ and CO were reacted in the presence of a titania supported cobalt rhenium catalyst to form hydrocarbons, most of which were liquid at the reaction conditions. The reaction was carried out at 422–428° F., 287–289 psig, and the gas feed was introduced up into the slurry at a linear velocity of from 12–17.5 cm/sec. The alpha of the hydrocarbon synthesis reaction was greater than 0.9. The paraffinic Fischer-Tropsch hydrocarbon product was subjected to a rough flash to separate and recover a 700° F.+ boiling fraction, which served as the waxy feed for the hydroisomerization. The boiling point distribution for the waxy feed is given in Table 1.

TABLE 1

| Wt. % Boiling Point Distribution of Fischer-Tropsch Reactor Waxy Feed | |
|---|---|
| IBP-500° F. | 1.0 |
| 500–700° F. | 28.1 |
| 700° F.+ | 70.9 |
| (1050° F.+) | (6.8) |

The 700° F.+ fraction was recovered by fractionation as the waxy feed for the hydroisomerization. This waxy feed was hydroisomerized by reacting with hydrogen in the presence of a dual function hydroisomerization catalyst which consisted of cobalt (CoO, 3.2 wt. %) and molybdenum ($MoO_3$, 15.2 wt. %) on an amorphous alumina-silica cogel acidic support, 15.5 wt. % of which was silica. The catalyst had a surface area of 266 $m^2/g$ and a pore volume ($P.V._{H2O}$) of 0.64 mL/g. The conditions for the hydroisomerization are set forth in Table 2 and were selected for a target of 50 wt. % feed conversion of the 700° F.+ fraction which is defined as:

$$700° \text{ F.+ Conv.}=[1-(\text{wt. \% } 700° \text{ F.+ in product})\div(\text{wt. \% } 700° \text{ F.+ in feed})]\times 100$$

TABLE 2

| Hydroisomerization Reaction Conditions | |
|---|---|
| Temperature, ° F. (° C.) | 713 (378) |
| $H_2$ Pressure, psig (pure) | 725 |
| $H_2$ Treat Gas Rate, SCF/B | 2500 |
| LHSV, v/v/h | 1.1 |
| Target 700° F. + Conversion, wt. % | 50 |

Thus, during the hydroisomerization the entire feed was hydroisomerized, with 50 wt. % of the 700° F.+ waxy feed converted to 700° F. − boiling products.

The hydroisomerate was fractionated into various lower boiling fuel components and a waxy 700° F. hydroisomerate which served as the feed for the dewaxing step. The 700° F. hydroisomerate was catalytically dewaxed to reduce the pour point by reacting with hydrogen in the presence of a dewaxing catalyst which comprised platinum on a support comprising 70 wt. % of the hydrogen form of mordenite and 30 wt. % of an inert alumina binder. The dewaxing conditions are given in Table 3. The dewaxate was then fractionated in a HIVAC distillation to yield the desired viscosity grade lubricating oil base stocks of the invention. The properties of one of these base stocks is shown in Table 4.

TABLE 3

| Catalytic Dewaxing Conditions | |
|---|---|
| Temperature, ° F. | 480–550 |
| $H_2$ Pressure, psig. | 725 |
| $H_2$ Treat Gas Rate, SCF/B | 2500 |
| LHSV, v/v/h | 1.1 |
| Target Lube Yield, wt. % | 80 |

TABLE 4

| Dewaxed Oil Properties | |
|---|---|
| Kinematic Viscosity at 40° C., cSt | 25.20 |
| Kinematic Viscosity at 100° C., cSt | 5.22 |
| Viscosity Index | 143 |
| Pour Point, ° C. | −16 |
| Noak, wt. % | 13 |
| CCS Viscosity at −20° C., cP | 810 |
| Yield, LV % on 700° F. + Hydroisomerate | 76.4 |

The oxidation resistance or stability of this base stock without any additives was evaluated along with the oxidation stability of similar viscosity grade PAO and using a bench oxidation test, in which 0.14 g of tertiarybutyl hydroperoxide was added to 10 g of base stock in a three neck flask equipped with a reflux condenser. After being maintained at 150° C. for an hour and cooled, the extent of oxidation was determined by measuring the intensity of the carboxylic acid peak by FT infrared spectroscopy at about 1720 $cm^{-1}$. The smaller the number is, the better is the oxidation stability as indicated by this test method. The results found in Table 5 show that both the PAO and F-T base stock of the invention are superior to the conventional base stock.

TABLE 5

| Base Stock | F(C = O) Intensity at 1720 $cm^{-1}$ |
|---|---|
| S150N | 2.19 |
| PAO | 1.29 |
| F-T | 1.29 |

Example 2

This experiment was similar to that of Example 1, except that both the oxidation and nitration resistance of the three base stocks without any additives were measured at the same time by a bench test. The test consists of adding 0.2 g of octadecyl nitrate to 19.8 g of the oil in a three neck flask fitted with a refluxing condenser and maintaining the contents at 170° C. for two hours, followed by cooling. FT infrared spectroscopy was used to measure the intensity of the carboxylic acid peak increase at 1720 cm−1 and the decay of the $C_{18}ONO_2$ peak at 1638 $cm^{-1}$. A smaller number for the 1720 $cm^{-1}$ peak indicates greater oxidation stability, while a larger intensity differential number at 1638 $cm^{-1}$ indicates better nitration resistance. In addition, the extent of nitration was monitored by determining the rate constant of the nitration reaction, with small numbers indicating less nitration. The nitration rate constants were: SISON k=0.619; PAO k=0.410, and F-T k=0.367. Thus the nitration rate constant was smallest for the base oil of the invention. This, along with the results shown in Table 6, demonstrate that the resistance to nitration and sludge formation exhibited by the base stock of the invention is superior to both the PAO base stock and the conventional mineral oil derived base stock (S150N).

TABLE 6

| Base stock | F(COO) Intensity at 1720 $cm^{-1}$ | Decay of $RONO_2$ at 1638 $cm^{-1}$ |
|---|---|---|
| S150N | 9.31 | −6.47 |
| PAO | 4.72 | −4.92 |
| F-T | 2.13 | −3.47 |

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A lubricant base stock comprising at least 95 wt. % non-cyclic isoparaffins having a molecular structure in which less than 25% of the total number of carbon atoms of the isoparaffin structure are contained in the branches and less than half of the total isoparaffin branches contain two or more carbon atoms.

2. A base stock according to claim 1 wherein at least half of the isoparaffin branches are methyl branches.

3. A base stock according to claim 2 wherein at least half of the remaining, non-methyl branches are ethyl, with less than 25% of the total number of branches having three or more carbon atoms.

4. A base stock according to claim 3 wherein at least 75% of the non-methyl branches are ethyl.

5. A base stock according to claim 4 wherein of the total number of carbon atoms contained in the isoparaffin molecule, 10–15% of the carbon atoms are located in the branches.

6. A base stock according to claim 1 in admixture with at least one of (i) a hydrocarbonaceous base stock and (ii) a synthetic base stock.

7. A base stock according to claim 3 in admixture with at least one of (i) a hydrocarbonaceous base stock and (ii) a synthetic base stock.

8. A base stock according to claim 5 in admixture with at least one of (i) a hydrocarbonaceous base stock and (ii) a synthetic base stock.

* * * * *

Disclaimer 6,080,301—Paul J. Beriowitz, E. Windsor; Jacob J. Habeeb, Westfield, both of NJ; Robert J. Wittenbrink, Baton Rouge, LA. PREMIUM SYNTHETIC LUBRICANT BASE STROCK HAVING AT LEAST 95% NON-CYCLIC ISOPARAFFINS. Patent dated June 27, 2000. Disclaimer filed July 9, 2001, by the assignee, Exxon Mobil Research and Engineering Company.

Hereby the term of this patent shall not extend beyond the expiration date of Pat. No. 6,008,164.

*(Official Gazette, December 25, 2001)*

Disclaimer 6,080,301—Paul J. Beriowitz, E. Windsor; Jacob J. Habeeb, Westfield, both of NJ; Robert J. Wittenbrink, Baton Rouge, LA.PREMIUM SYNTHETIC LUBRICANT BASE STROCK HAVING AT LEAST 95% NON-CYCLIC ISOPARAFFINS.Patent dated June 27, 2000.Disclaimer filed July 9, 2001, by assignee, ExxonMobil Research and Engineering Company.

Hereby the term of this patent shall not extend beyond the expiration date of Pat. No. 6,008,164.

*(Official Gazette, January 8, 2002)*